US011795559B2

(12) United States Patent
Räisä et al.

(10) Patent No.: US 11,795,559 B2
(45) Date of Patent: Oct. 24, 2023

(54) ADHESION OF A CHROMIUM-BASED COATING ON A SUBSTRATE

(71) Applicant: Savroc Ltd, Kuopio (FI)

(72) Inventors: Jussi Räisä, Kuopio (FI); Arto Yli-Pentti, Klaukkala (FI)

(73) Assignee: Savroc Ltd, Kuopio (FI)

( * ) Notice: Subject to any disclaimer, the term of this patent is extended or adjusted under 35 U.S.C. 154(b) by 0 days.

(21) Appl. No.: 17/919,688

(22) PCT Filed: Apr. 21, 2021

(86) PCT No.: PCT/FI2021/050298
§ 371 (c)(1),
(2) Date: Oct. 18, 2022

(87) PCT Pub. No.: WO2021/214390
PCT Pub. Date: Oct. 28, 2021

(65) Prior Publication Data

US 2023/0145456 A1 May 11, 2023

(30) Foreign Application Priority Data

Apr. 23, 2020 (FI) ..... 20205408

(51) Int. Cl.
*C25D 3/06* (2006.01)
*C25D 3/10* (2006.01)
(Continued)

(52) U.S. Cl.
CPC ..... *C25D 3/06* (2013.01); *C25D 3/10* (2013.01); *C25D 5/14* (2013.01); *C25D 5/617* (2020.08)

(58) Field of Classification Search
None
See application file for complete search history.

(56) References Cited

U.S. PATENT DOCUMENTS 4,093,521 A 6/1978 Renton et al.
4,184,929 A 1/1980 Tomaszewski et al.
(Continued)

FOREIGN PATENT DOCUMENTS

CN 101392394 3/2009
CN 101410556 4/2009
(Continued)

OTHER PUBLICATIONS

AU Application No. 2021260899 Office Action, dated Nov. 25, 2022 , 3 pages.
(Continued)

*Primary Examiner* — Seth Dumbris
(74) *Attorney, Agent, or Firm* — DeLizio, Peacock, Lewin & Guerra, LLP

(57) ABSTRACT

An object comprising a chromium-based coating on a substrate is disclosed. The chromium is electroplated from an aqueous electroplating bath comprising trivalent chromium cations, wherein the chromium-based coating comprises: a first chromium-containing layer, on the substrate, having a thickness of at least 100 nm, and a Vickers microhardness value of 700-1000 HV; a second chromium-containing layer, on the first chromium-containing layer, having a Vickers microhardness value that is at least 1.3 times higher than the Vickers microhardness value of the first chromium-containing layer, and a crystal size of 8-35 nm; and wherein the chromium-based coating exhibits a critical scratch load value ($L_{C2}$) of at least 60 N in the adhesion test according to ASTM C1624-05 (2015; point 11.11.4.4), and wherein the chromium-based coating does not contain chromium carbide. Further is disclosed a method for its production.

18 Claims, 1 Drawing Sheet

(51) Int. Cl.
*C25D 5/00* (2006.01)
*C25D 5/14* (2006.01)

(56) References Cited

U.S. PATENT DOCUMENTS

| | | | | |
|---|---|---|---|---|
| 4,690,735 | A | 9/1987 | Laitinen et al. | |
| 5,415,763 | A | 5/1995 | Johnson et al. | |
| 5,759,243 | A | 6/1998 | Johnson | |
| 6,329,071 | B1 * | 12/2001 | Kobayashi | C25D 5/617 205/104 |
| 2009/0114544 | A1 | 5/2009 | Rousseau | |
| 2015/0361571 | A1 | 12/2015 | Miettinen et al. | |
| 2016/0318282 | A1 * | 11/2016 | Muchtar | B23K 35/308 |
| 2017/0009361 | A1 | 1/2017 | Dal Ziliio et al. | |
| 2017/0159198 | A1 | 6/2017 | Miettinen et al. | |
| 2019/0040540 | A1 * | 2/2019 | Raisa | C25D 3/06 |
| 2019/0309430 | A1 | 10/2019 | Sklar | |
| 2021/0017659 | A1 | 1/2021 | Ijeri et al. | |

FOREIGN PATENT DOCUMENTS

| | | |
|---|---|---|
| CN | 109537002 | 3/2019 |
| EP | 2980280 | 2/2016 |
| FR | 2331628 | 6/1977 |
| GB | 1482747 | 8/1977 |
| GB | 1592761 | 7/1981 |
| WO | 2016044708 | 3/2016 |
| WO | 2021214389 | 10/2021 |
| WO | 2021214390 | 10/2021 |

OTHER PUBLICATIONS

"FI Search Report for 20205408", dated Oct. 2, 2020 , 1 pg.
"PCT/FI2021/050298 International Search Report and Written Opinion", dated Jul. 12, 2021 , 11 pgs.
"CN Application No. 202180030113.4 Office Action", dated Apr. 17, 2023, 17 pages.
"CN Application No. 202180030423.6 Office Action", dated May 23, 2023, 12 pages.
"Standard Guide for Conducting Wear Tests Using a Rotary Platform Abraser", ASTM International G195-18, Jan. 1, 2018, 10 pages.
"U.S. Appl. No. 17/996,632 Office Action", dated May 10, 2023, 10 pages.
"U.S. Appl. No. 17/996,642 Office Action", dated Mar. 29, 2023, 6 pages.
Oduoza, et al., "Chromium Electroplating of Aluminium Alloys Using Electroless Nickel as Underlayer", Journal of Materials Science and Chemical Engineering, Jan. 1, 2014—ISSN 2327-6045, vol. 2, Nr.7, pp. 59-74, Jul. 1, 2014, 17.

* cited by examiner

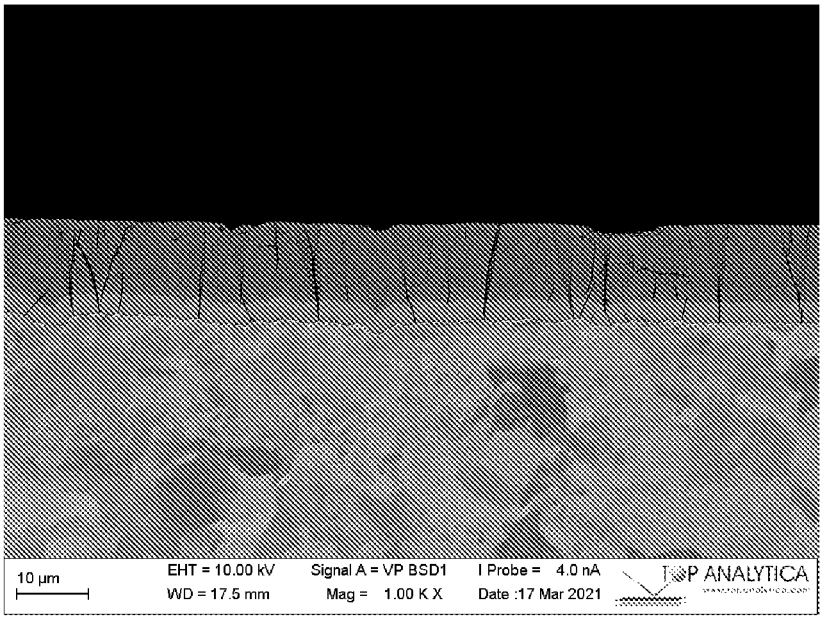
10 µm
EHT = 10.00 kV
WD = 17.5 mm
Signal A = VP BSD1
Mag = 1.00 K X
I Probe = 4.0 nA
Date :17 Mar 2021
TESCAN ANALYTICA

ADHESION OF A CHROMIUM-BASED COATING ON A SUBSTRATE

TECHNICAL FIELD

The present disclosure relates to an object comprising a chromium-based coating on a substrate. The present disclosure further relates to a method for producing an object comprising a chromium-based coating on a substrate.

BACKGROUND

Objects which are utilized in demanding environmental conditions often require mechanical or chemical protection, so as to prevent the environmental conditions from affecting the object. Protection to the object can be realized by applying a coating thereon, i.e., on the substrate. Disclosed are protective coatings for various purposes; hard-coatings that protect the substrate from mechanical effects and diffusion barriers for protection against chemical effects. However, further manners to produce hard-coatings in an environmentally friendly manner are needed.

SUMMARY

An object comprising a chromium-based coating on a substrate is disclosed. The chromium is electroplated from an aqueous electroplating bath comprising trivalent chromium cations. The chromium-based coating comprises:

a first chromium-containing layer, on the substrate, having a thickness of at least 100 nm, and a Vickers microhardness value of 700-1000 HV; and a second chromium-containing layer, on the first chromium-containing layer, having a Vickers microhardness value that is at least 1.3 times higher than the Vickers microhardness value of the first chromium-containing layer, and a crystal size of 8-35 nm.

The chromium-based coating exhibits a critical scratch load value ($L_{C2}$) of at least 60 N in the adhesion test according to ASTM C1624-05 (2015; point 11.11.4.4). In the adhesion test the critical scratch load value ($L_{C2}$) is recorded as the normal force at which damage is first observed. I.e. $L_{C2}$ is associated with the start of chipping failure extending from the arc tensile cracks, indicating adhesive failure between the coating and the substrate or part of the substrate.

The chromium-based coating does not contain chromium carbide.

Further is disclosed a method for producing an object comprising a chromium-based coating on a substrate. The method comprises:

depositing a first chromium-containing layer on the substrate by subjecting the substrate to a first electroplating cycle from an aqueous electro-plating bath comprising trivalent chromium cations, wherein the first electroplating cycle is carried out at a current density of 20-90 A/dm2 for 0.5-20 minutes to produce a first chromium-containing layer having a thickness of at least 100 nm, and a Vickers microhardness value of 700-1000 HV; and depositing a second chromium-containing layer on the first chromium-containing layer by subjecting the first chromium-containing layer to a second electroplating cycle from an aqueous electroplating bath comprising trivalent chromium cations, wherein the second electroplating cycle is carried out at a current density of 50-300 A/dm$^2$ such that during the second electroplating cycle the current density is kept at a value of at least 100 A/dm$^2$ before ending the second electroplating cycle, to produce a second chromium-containing layer having a Vickers microhardness value that is at least 1.3 times higher than the Vickers microhardness value of the first chromium-containing layer, and a crystal size of 8-35 nm;

for improving the adhesion of the chromium-based coating to the substrate.

BRIEF DESCRIPTION OF THE DRAWINGS

The accompanying drawing, which is included to provide a further understanding of the embodiments and constitutes a part of this specification, illustrates an embodiment. In the drawing:

FIG. 1 discloses a cross-section view of an image taken by scanning electron microscope (SEM) of a chromium-based coating prepared as disclosed in the current specification.

DETAILED DESCRIPTION

The present disclosure relates to an object comprising a chromium-based coating on a substrate. The chromium is electroplated from an aqueous electroplating bath comprising trivalent chromium cations. The chromium-based coating comprises:

a first chromium-containing layer, on the substrate, having a thickness of at least 100 nm, and a Vickers microhardness value of 700-1000 HV; and a second chromium-containing layer, on the first chromium-containing layer, having a Vickers microhardness value that is at least 1.3 times higher than the Vickers microhardness value of the first chromium-containing layer, and a crystal size of 8-35 nm.

The chromium-based coating exhibits a critical scratch load value ($L_{C2}$) of at least 60 N in the adhesion test according to ASTM C1624-05 (2015; point 11.11.4.4). The chromium-based coating does not contain chromium carbide.

Further, the present disclosure relates to a method for producing an object comprising a chromium-based coating on a substrate. The method comprises:

depositing a first chromium-containing layer on the substrate by subjecting the substrate to a first electroplating cycle from an aqueous electroplating bath comprising trivalent chromium cations, wherein the first electroplating cycle is carried out at a current density of 20-90 A/dm$^2$ for 0.5-20 minutes to produce a first chromium-containing layer having a thickness of at least 100 nm, a Vickers microhardness value of 700-1000 HV; and depositing a second chromium-containing layer on the first chromium-containing layer by subjecting the first chromium-containing layer to a second electroplating cycle from an aqueous electroplating bath comprising trivalent chromium cations, wherein the second electroplating cycle is carried out at a current density of 50-300 A/dm$^2$ such that during the second electroplating cycle the current density is kept at a value of at least 100 A/dm$^2$ before ending the second electroplating cycle, to produce a second chromium-containing layer having a Vickers microhardness value that is at least 1.3 times higher than the Vickers microhardness value of the first chromium-containing layer, and a crystal size of 8-35 nm;

for improving the adhesion of the chromium-based coating to the substrate.

In one embodiment, the electroplating is direct current (DC) electroplating.

In one embodiment, the method for producing an object comprising a chromium-based coating on a substrate comprises producing the object comprising a chromium-based coating on a substrate as defined in the current specification.

The inventors surprisingly found out that the adhesion of the chromium-based coating to the substrate may be improved or increased by the method as disclosed in the current specification. The chromium-based coating exhibits a critical scratch load value ($L_{C2}$) of at least 60 N in the adhesion test according to ASTM C1624-05 (2015; point 11.11.4.4).

In one embodiment, the chromium-based coating exhibits a critical scratch load value of at least 80 N, or at least 100 N, or at least 120 N, or at least 150 N, in the adhesion test.

In one embodiment, neither the first chromium-containing layer nor the second chromium-containing layer is subjected to a heat treatment. In one embodiment, the method for producing the chromium-based coating is carried out without subjecting the first chromium-containing layer or the second chromium-containing layer to a heat treatment. The inventors surprisingly found out that with the method as disclosed in the current specification, it is possible to produce a hard chromium-based coating having a Vickers microhardness value of 1000-2000 HV without the use of a heat treatment of the chromium-containing layers deposited from the electroplating bath. The expression "heat treatment" should be understood in this specification, unless otherwise stated, as referring to subjecting the deposited chromium-containing layers to a heat treatment at a temperature of 300-1200° C. for a period of time that would result in the formation of chromium carbides in the chromium-based coating. Such a heat treatment may further change the crystalline structure of chromium. I.e. the method for producing the chromium-based coating may comprise the provision that the deposited chromium-containing layers are not subjected to a heat treatment to form a chromium-based coating having a Vickers microhardness value of 1000-2000 H V. This provision may not, however, exclude e.g. dehydrogenation annealing.

The Vickers microhardness may be determined according to standard ISO 14577-1:2015.

In one embodiment, the first chromium-containing layer has a Vickers microhardness value of 800-900 HV. In one embodiment, the second chromium-containing layer has a Vickers microhardness value of 900-2000 HV, or 1000-1900 HV, or 1200-1800 HV.

In one embodiment, the second chromium-containing layer has a Vickers microhardness value that is at least 1.4 times, or at least 1.5, or at least 1.6 times, higher than the Vickers microhardness value of the first chromium-containing layer. In one embodiment, the second chromium-containing layer has a Vickers microhardness value that is 1.3-2.85 times, or 1.4-2.5 times, or 1.5-2.0 times, higher than the Vickers microhardness value of the first chromium-containing layer.

The thickness may be determined by measuring from the cross-section view of an image taken by scanning electron microscope (SEM).

In one embodiment, the first chromium-containing layer has a thickness of at least 200 nm, or at least 500 nm, or at least 1000 nm. In one embodiment, the first chromium-containing layer has a thickness of 100 nm-10 μm, or 500 nm-5 μm, or 2.5-3.5 μm or about 3 μm. In one embodiment, the first electroplating cycle is continued until a first chromium-containing layer having a thickness of 100 nm-10 μm, or 500 nm-5 μm, or 2.5-3.5 μm, or about 3 μm, is formed.

In one embodiment, the thickness of the first chromium-containing layer is not greater than the thickness of the second chromium-containing layer.

In one embodiment, the thickness of the second chromium-containing layer is at least 2 times, or at least 3 times, or at least 4 times, greater than the thickness of the first chromium-containing layer. In one embodiment, the second electroplating cycle is continued until a second chromium-containing layer having a thickness that is at least 2 times, or at least 3 times, or at least 4 times, greater than the thickness of the first chromium-containing layer, is formed. In one embodiment, the thickness of the second chromium-containing layer is 2-5 times, or 3-4 times, greater than the thickness of the first chromium-containing layer.

In one embodiment, the second electroplating cycle is continued for 0.5-100 minutes, or 1-25 minutes, or 5-20 minutes, or 5-10 minutes.

In one embodiment, the second chromium-containing layer has a crystal size of 8-35 nm, 12-30 nm, or 14-25 nm.

The crystal size may be determined in the following manner:

Samples are measured with X-ray diffraction (XRD) in a Grazing incidence (GID) geometry. In GID-geometry the X-rays are targeted on the sample with a small incident angle and held constant during the measurement. In this way, the X-rays can be focused on the surface layers of the sample, with the purpose of minimizing the signal from the substrate. The measurements are performed on a 2θ angular range of 30°-120°, with increments of 0.075°. A total measurement time for each sample is 1 h. The incident angle of X-rays is 4°. In addition to the samples, a corundum standard (NIST SRM 1976a) was measured with identical setup to measure the instrumental broadening of diffraction peaks. The measurements are performed on a Bruker D8 DISCOVER diffractometer equipped with a Cu Kα X-ray source. The X-rays are parallelized with a Göbel mirror, and are limited on the primary side with a 1 mm slit. An equatorial soller slit of 0.2° is used on the secondary side. The phases from the samples are identified from the measured diffractograms with DIF-FRAC.EVA 3.1 software utilizing PDF-2 2015 database. The crystal sizes and lattice parameters are determined from the samples by full profile fitting performed on TOPAS 4.2 software. The instrumental broadening is determined from the measurement of the corundum standard. The crystal sizes are calculated using the Scherrer equation [see Patterson, A. (1939). "The Scherrer Formula for X-Ray Particle Size Determination". Phys. Rev. 56 (10): 978-982.], where the peak widths are determined with the integral breadth method [see Scardi, P., Leoni, M., Delhez, R. (2004). "Line broadening analysis using integral breadth methods: A critical review". J. Appl. Chrystallogr. 37: 381-390]. The obtained values for lattice parameters are compared to literature values. The difference in measured values and literature values suggest the presence of residual stress within the coating.

In one embodiment, the second chromium-containing layer is characterized by an X-ray powder diffraction pattern containing specific peaks at 44.5°, 64.7°, 81.8°, 98.2°, and 115.3° 2theta (2θ). In one embodiment, the second chromium-containing layer is characterized by an X-ray powder diffraction pattern containing a highest peak at 44.5° and a second highest peak at 81.8° 2theta.

The chromium-based coating may comprise 87-99 weight-%, or 92-97 weight-% of chromium. The chromium-based coating may comprise 0.3-5 weight-%, or 1.0-3.0 weight-% of carbon. The chromium-based coating may also comprise nickel and/or iron. The chromium-based coating may comprise also other elements. The chromium-based coating may in addition comprise oxygen and/or nitrogen.

As is clear to the skilled person, the chromium-based coating may in addition to the materials presented above contain minor amounts of residual elements and/or compounds originating from manufacturing process, such as the electroplating process. Examples of such further elements are copper (Cu), zinc (Zn), and any compounds including the same.

The amounts of different elements, such a chromium, iron, nickel, etc., in the chromium-based coating may be measured and determined with an XRF analyzer. The amount of carbon in the chromium-based coating may be measured and determined with an infrared (IR) detector. An example of such a detector is the Leco C230 carbon detector.

As is clear to the skilled person, the total amount of the different elements in the chromium-based coating may not exceed 100 weight-%. The amount in weight-% of the different elements in the chromium-based coating may vary between the given ranges.

In one embodiment, the object is a gas turbine, shock absorber, hydraulic cylinder, linked pin, joint pin, a bush ring, a round rod, a valve, a ball valve, or an engine valve.

Some methods, in order to achieve hard chromium-based coatings with a Vickers microhardness value of at least 900 HV, may have required the use of at least one heat treatment of the deposited chromium-containing layer(s) at a temperature of 300-1200° C., when using an aqueous electroplating bath in which chromium is present substantially only in the trivalent form. By omitting this kind of heat treatment, one may be able to form a chromium-based coating that essentially lacks chromium carbides. The term "chromium carbide" is herein to be understood to include all the chemical compositions of chromium carbide. Examples of chromium carbides that may be present in the first layer are $Cr_3C_2$, $Cr_7C_3$, $Cr_{23}C_6$, or any combination of these. Such chromium carbides are usually formed into the chromium-based coating when the chromium-containing layer(s) deposited on a substrate by electroplating from a trivalent chromium bath is subjected to at least one heat treatment at the temperature of 300-1200° C.

In this specification, unless otherwise stated, the terms "electroplating", "electrolytic plating" and "electrodeposition" are to be understood as synonyms. By depositing a chromium-containing layer on the substrate, or at a later stage on the first chromium-containing layer, is herein meant depositing a layer directly on the substrate, or at a later stage on the first chromium-containing layer, to be coated. In the present disclosure, the chromium-containing layer(s) may be deposited through electroplating from an aqueous electroplating bath comprising trivalent chromium cations. In this connection, the wording electroplating "from an aqueous electroplating bath comprising trivalent chromium cations" is used to define a process step in which the deposition is taking place from an electrolytic bath in which chromium is present substantially only in the trivalent form.

In one embodiment, the first electroplating cycle is carried out while keeping the temperature of the aqueous electroplating bath at 50-70° C., or 55-65° C., or 58-62° C. The rather low temperature of the aqueous electroplating bath used in the first electroplating cycle has the added utility of improving the adhesion of the first chromium-containing layer and thus the whole formed chromium-based coating to the substrate.

In one embodiment, the second electroplating cycle is carried out while keeping the temperature of the aqueous electroplating bath at 40-60° C., or 45-55° C., or 48-52° C.

The first electroplating cycle is carried out at a current density of 20-90 A/dm$^2$ for 0.5-20 minutes. The inventors surprisingly found out that when the chromium-based coating is formed by firstly producing a chromium-containing layer by using a rather low current density compared to the one used when producing the second chromium-containing layer, the crystal size and structure may be affected in a beneficial manner when compared to directly using a higher current density, such as 100 A/dm$^2$ or above.

In one embodiment, the first electroplating cycle is carried out at a current density of 20-80 A/dm$^2$, or 30-80 A/dm$^2$, or 30-70 A/dm$^2$, or 30-60 A/dm$^2$, or 30-50 A/dm$^2$, 40-70 A/dm$^2$, or 40-60 A/dm$^2$, or 40-50 A/dm$^2$.

The second electroplating cycle is carried out at a current density of 50-300 A/dm$^2$ such that during the second electroplating cycle the current density is kept at a value of at least 100 A/dm$^2$ before the second electroplating cycle is ended or stopped. In one embodiment, the second electroplating cycle is carried out at a current density of 80-250 A/dm$^2$, or 100-200 A/dm$^2$, or 130-180 A/dm$^2$, 140-170 A/dm$^2$. Increasing the current density during the second electroplating cycle to at least 100 A/dm$^2$ has the added utility of hindering or decreasing the formation of macrocracks in the chromium-based coating. Using an aqueous electroplating bath of trivalent chromium cations may result in that macrocracks are formed in the coating. The inventors surprisingly found out that these macrocracks may be prevented by using the higher current density in the second electroplating cycle.

During the second electroplating cycle, the current density is kept at a value of at least at least 100 A/dm$^2$, or at least 110 A/dm$^2$, or at least 120 A/dm$^2$, or at least 130 A/dm$^2$, or at least 140 A/dm$^2$, or at least 150 A/dm$^2$, before ending the second electroplating cycle.

In one embodiment, during the second electroplating cycle the current density is increased to at least 100 A/dm$^2$, or at least 110 A/dm$^2$, or at least 120 A/dm$^2$, or at least 130 A/dm$^2$, or at least 140 A/dm$^2$, or at least 150 A/dm$^2$, before ending the second electroplating cycle.

The current density used in the second electroplating cycle may be at least 110 A/dm$^2$ already from the beginning of the second electroplating cycle. Alternatively, the current density, during the second electroplating cycle, may first be lower and then later increased to at least 110 A/dm$^2$.

In one embodiment, the current density is kept at a value of at least 100 A/dm$^2$, or at least 110 A/dm$^2$, or at least 120 A/dm$^2$, or at least 130 A/dm$^2$, or at least 140 A/dm$^2$, or at least 150 A/dm$^2$, for 1-100 minutes, or 3-25 minutes, before ending the second electroplating cycle.

In one embodiment, the second electroplating cycle comprises firstly carrying out the second electroplating cycle at a current density of 50-100 A/dm$^2$, or 65-85 A/dm$^2$, for 1-3 minutes, and thereafter at a current density of 100-300 A/dm$^2$, or 150-250 A/dm$^2$, or 180-220 A/dm$^2$, for 5-20 minutes. In one embodiment, the temperature of the aqueous electroplating bath is kept at 35-60° C., or 40-50° C.

In one embodiment, the aqueous electroplating bath used in the first electroplating cycle is different from the aqueous electroplating bath used in the second electroplating cycle. In one embodiment, the aqueous electroplating bath used in the first electroplating cycle is the same aqueous electroplating bath as used in the second electroplating cycle. The first electroplating cycle and the second electroplating cycle may be carried out in the one and the same aqueous electroplating bath or in different aqueous electroplating baths.

The aqueous electroplating bath comprising trivalent chromium cations may in addition to trivalent chromium cations comprise carboxylate ions. The bath may comprise trivalent chromium cations in an amount of 0.12-0.3 mol/l, or 0.13-0.24 mol/l, or 0.17-0.21 mol/l. The bath may comprise carboxylate ions in an amount of 1.22-7.4 mol/l, or 2.0-6.0 mol/l, or 2.3-3.2 mol/l. The molar ratio of trivalent chromium cations to the carboxylate ions may be 0.015-0.099, or 0.015-0.09, or 0.03-0.08, or 0.065-0.075 in the aqueous electroplating bath.

Any soluble trivalent chromium salt(s) may be used as the source of the trivalent chromium cations. Examples of such trivalent chromium salts are potassium chromium sulfate, chromium(III)acetate, and chromium(III) chloride.

The source of carboxylate ions may be a carboxylic acid, such as formic acid, acetic acid, or citric acid, or any combination thereof.

The aqueous electroplating bath may further contain iron cations and/or nickel cations. The aqueous electroplating bath may comprise iron cations in an amount of 0.18-3.6 mmol/l, or 0.23-0.4 mmol/l. The aqueous electroplating bath may comprise nickel cations in an amount of 0.0-2.56 mmol/l, or 0.53-1.2 mmol/l. The aqueous electroplating bath may comprise iron cations and nickel cations in an amount of 0.18-6.16 mmol/l, or 0.76-1.6 mmol/l.

The aqueous electroplating bath may comprise bromide ions in an amount of 0.15-0.3 mol/l, or 0.21-0.25 mol/l. The source of the bromide ions may be selected from a group consisting of potassium bromide, sodium bromide, ammonium bromide, and any combination or mixture thereof.

The aqueous electroplating bath may comprise ammonium ions in an amount of 2-10 mol/l, or 2.1-8 mol/l, or 2.2-6 mol/l, or 2.5-4.5 mol/l, or 3-4 mol/l. The source of the ammonium ions may be selected from a group consisting of ammonium chloride, ammonium sulfate, ammonium formate, ammonium acetate, and any combination or mixture thereof.

The pH of the aqueous electroplating bath may be 2-6, or 3-5.5, or 4.5-5.5, or 4.1-5. The pH may be adjusted by including a base in the aqueous electroplating bath when needed. Ammonium hydroxide, sodium hydroxide, and potassium hydroxide may be mentioned as examples of bases that may be used for adjusting the pH of the aqueous electroplating bath.

The conductivity of the aqueous electroplating bath may be 160-400 mS/cm, or 200-350 mS/cm, or 250-300 mS/cm. The conductivity of the aqueous electroplating bath may be adjusted with the use of e.g. different salts for conductivity. Ammonium chloride, potassium chloride, and sodium chloride can be mentioned as examples of salts that may be used to adjust the conductivity. The conductivity may be determined e.g. in compliance with standard EN 27888 (water quality; determination of electrical conductivity (ISO 7888: 1985)).

The method and the chromium-based coating as disclosed in the current specification are well suited for protecting metal substrates from corrosion. In one embodiment, the corrosion resistance of the object is at least 24 h, or at least 48 h, or at least 96 h, or at least 168 h, or at least 240 h, or at least 480 h. The corrosion resistance can be determined in accordance with standard EN ISO 9227 NSS (neutral salt spray) rating 9 or 10 (2017).

By a "substrate" is herein meant any component or body on which the chromium-based coating as disclosed in the current specification is coated on. Generally, the chromium-based coating as disclosed in the current specification can be used on variable substrates. In one embodiment, the substrate comprises or consists of metal, a combination of metals, or a metal alloy. In one embodiment, the substrate is made of steel, copper, nickel, iron, or any combination thereof. The substrate can be made of ceramic material. The substrate does not need to be homogenous material. In other words, the substrate may be heterogeneous material. The substrate can be layered. For example, the substrate can be a steel object coated by a layer of nickel, or nickel phosphorus alloy (Ni—P). In one embodiment, the substrate is a cutting tool, for example a cutting blade. In one embodiment, the substrate is a cutting tool comprising metal.

In one embodiment, the object comprising a chromium-based coating on a substrate does not comprise a layer of nickel. In one embodiment, the chromium-based coating does not comprise a layer of nickel. In one embodiment, the substrate does not comprise a layer of nickel.

The object disclosed in the current specification has the added utility of being well suited for applications wherein hardness of the object is relevant. The materials of the chromium-based coating have the added utility of providing the substrate a hardness suitable for specific applications requiring high durability of the object.

The object disclosed in the current specification has the added utility of the chromium-based coating exhibiting good adhesion to the substrate as a result of the production method as disclosed in the current specification.

The chromium-based coating has the added utility of protecting the underlying substrate from effects caused by the interaction with the environment during use. The chromium-based coating has the added utility of providing a good corrosion resistance. The chromium-based coating further has the added utility of being formed from trivalent chromium, whereby the environmental impact is less than when using hexavalent chromium. Further, the method as disclosed in the current specification has the added utility of being a safer production method for a chromium-based coating than if hexavalent chromium is used. Further, being able to omit the heat treatment of the chromium-containing layer while still providing a chromium-based coating with a high Vickers microhardness value and good adhesion of the chromium-based coating on the substrate, has the added utility of simplifying the production method and thus beneficially affects the production costs.

EXAMPLES

Reference will now be made in detail to various embodiments, examples of which are illustrated in the accompanying drawings.

The description below discloses some embodiments in such a detail that a person skilled in the art is able to utilize the embodiments based on the disclosure. Not all steps or features of the embodiments are discussed in detail, as many of the steps or features will be obvious for the person skilled in the art based on this specification.

FIG. 1 discloses a cross-section view of an image taken by scanning electron microscope (SEM) of a chromium-based coating prepared as disclosed in the current specification. From FIG. 1 one can see a clear difference in the color of the two separate chromium-containing layers.

Example 1—Preparing a Chromium-Based Coating on a Substrate

In this example different objects, each comprising a chromium-based coating on a substrate, were prepared.

Firstly, the substrates were pre-treated by cleaning the metal substrates, i.e. CK45 steel substrates, and providing thereon by electroplating and as a part of the substrate a nickel layer having a thickness of about 3-4 μm. Thereafter the substrates were rinsed with water after which the chromium-based coating was formed on the substrate.

The aqueous electroplating bath comprised the following:

| Component | Aqueous electroplating bath |
|---|---|
| $Cr^{3+}$ [mol/l] | 0.19 |
| Molar ratio of $Cr^{3+}$ to formate ion or equivalent amount of carboxylate ions | 0.08 |
| $COOH^-$ ions [mol/l] | 2.4 |
| KBr [mol/l] | 0.23 |
| Fe [mmol/l] | 0.27 |
| Ni [mmol/l] | 0.0 |
| water | balance |
| pH | 5 |
| Conductivity [mS/cm] | 330 |

The aqueous electroplating bath was subjected to a normal initial plating, after which it was ready for use.

Firstly a first chromium-containing layer was deposited on the substrate by subjecting the substrate to a first electroplating cycle. The first electroplating cycle was carried out as follows:

Current density: 60 A/dm$^2$

Time: 4 minutes

Temperature of the bath: 60° C.

The properties of the first chromium-containing layer were measured according to measurement methods presented above in the current specification and the results are presented below:

Thickness: 4 μm

Vickers microhardness value: 800 HV

Then a second chromium-containing layer was deposited on the first chromium-containing layer by subjecting the first chromium-containing layer to a second electroplating cycle. The second electroplating cycle was carried out as follows:

Current density: 120-150 A/dm$^2$

Time: 8 minutes

Temperature of the bath: 50° C.

The properties of the second chromium-containing layer were measured according to measurement methods presented above in the current specification and the results are presented below:

Thickness: 24 μm

Vickers microhardness value: 1450 HV

Crystal size: 23 nm

It is obvious to a person skilled in the art that with the advancement of technology, the basic idea may be implemented in various ways. The embodiments are thus not limited to the examples described above; instead, they may vary within the scope of the claims.

The embodiments described hereinbefore may be used in any combination with each other. Several of the embodiments may be combined together to form a further embodiment. An object, or a method, disclosed herein, may comprise at least one of the embodiments described hereinbefore. It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. The term "comprising" is used in this specification to mean including the feature(s) or act(s) followed thereafter, without excluding the presence of one or more additional features or acts.

The invention claimed is:

1. An object comprising:

a chromium-based coating on a substrate, wherein the chromium is electroplated from an aqueous electroplating bath comprising trivalent chromium cations, wherein the chromium-based coating comprises:

a first chromium-containing layer, on the substrate, having a thickness of at least 100 nanometers (nm), and a Vickers microhardness value of 700-1000 HV;

a second chromium-containing layer, on the first chromium-containing layer, having a Vickers microhardness value that is at least 1.3 times higher than the Vickers microhardness value of the first chromium-containing layer, and a crystal size of 8-35 nm; and wherein the chromium-based coating exhibits a critical scratch load value ($L_{C2}$) of at least 60 N in an adhesion test according to ASTM C1624-05 (2015; point 11.11.4.4), and wherein the chromium-based coating does not contain chromium carbide.

2. The object of claim 1, wherein the first chromium-containing layer has a Vickers microhardness value of 800-900 HV.

3. The object of claim 1, wherein the second chromium-containing layer has a Vickers microhardness value of 900-2000 HV, or 1000-1900 HV, or 1200-1800 HV.

4. The object of claim 1, wherein the first chromium-containing layer has a thickness of 100 nm-10 micrometer (μm), or 500 nm-5 μm, or 2.5-3.5 μm.

5. The object of claim 1, wherein the thickness of the second chromium-containing layer is at least 2 times, or at least 3 times, or at least 4 times, greater than the thickness of the first chromium-containing layer.

6. The object of claim 1, wherein the second chromium-containing layer has a crystal size of 12-30 nm, or 14-25 nm.

7. The object of claim 1, wherein the chromium-based coating exhibits a critical scratch load value of at least 80 N, or at least 100 N, or at least 120 N, or at least 150 N, in the adhesion test according to ASTM C1624-05 (2015; point 11.11.4.4).

8. The object of claim 1, wherein the object is a gas turbine, shock absorber, hydraulic cylinder, linked pin, joint pin, a bush ring, a round rod, a valve, a ball valve, or an engine valve.

9. A method for producing an object comprising a chromium-based coating on a substrate, wherein the method comprises:

depositing a first chromium-containing layer on the substrate by subjecting the substrate to a first electroplating cycle from an aqueous electroplating bath comprising trivalent chromium cations, wherein the first electroplating cycle is carried out at a current density of 20-90 Amperes per 1 square decimeter (A/dm$^2$) for 0.5-20 minutes to produce a first chromium-containing layer having a thickness of at least 100 nm, and a Vickers microhardness value of 700-1000 HV; and depositing a second chromium-containing layer on the first chromium-containing layer by subjecting the first chromium-containing layer to a second electroplating cycle from an aqueous electroplating bath comprising trivalent chromium cations, where-in the second electroplating cycle is carried out at a current density of 50-300 A/dm$^2$ such that during the second electroplating cycle the current density is kept at a value of at least 100 A/dm$^2$ before ending the second electroplating cycle, to produce a second chromium-containing layer having a Vickers microhardness value that is at least 1.3 times higher than the Vickers microhardness value of the first chromium-containing layer, and a crystal size of 8-35 nm.

10. The method of claim 9, wherein the chromium-based coating exhibits a critical scratch load value of at least 60 N, or at least 80 N, or at least 100 N, or at least 120 N, or at least 150 N, in an adhesion test according to ASTM C1624-05 (2015; point 11.11.4.4).

11. The method of claim 9, wherein first electroplating cycle is carried out while keeping the temperature of the aqueous electroplating bath at 50-70° C., or 55-65° C., or 58-62° C.

12. The method of claim 9, wherein second electroplating cycle is carried out while keeping the temperature of the aqueous electroplating bath at 40-60° C., or 45-55° C., or 48-52° C.

13. The method of claim 9, wherein the first electroplating cycle is continued until the first chromium-containing layer having a thickness of 100 nm-10 μm, or 500 nm-5 μm, or 2.5-3.5 μm, is formed.

14. The method of claim 9, wherein the second electroplating cycle is continued until the second chromium-containing layer having a thickness that is at least 2 times, or at least 3 times, or at least 4 times, greater than the thickness of the first chromium-containing layer, is formed.

15. The method of claim 9, wherein the second electroplating cycle is continued for 0.5-100 minutes, or 1-25 minutes, or 5-20 minutes, or 5-10 minutes.

16. The method of claim 9, wherein the second electroplating cycle comprises firstly carrying out the second electroplating cycle at a current density of 50-100 A/dm$^2$, or 65-85 A/dm$^2$, for 1-3 minutes, and thereafter at a current density of 100-300 A/dm$^2$, or 150-250 A/dm$^2$, or 180-220 A/dm$^2$, for 5-20 minutes.

17. The method of claim 16, wherein the temperature of the aqueous electroplating bath is kept at 35-60° C., or 40-50° C.

18. The method of claim 9, wherein neither the first chromium-containing layer nor the second chromium-containing layer is subjected to a heat treatment.

* * * * *